United States Patent [19]

Holt

[11] 4,117,535

[45] Sep. 26, 1978

[54] LIGHT FITTINGS

[76] Inventor: John Ruy Holt, 189 St. Pancras Way, College Green, London, England

[21] Appl. No.: 697,363

[22] Filed: Jun. 18, 1976

[30] Foreign Application Priority Data

Jun. 21, 1975 [GB] United Kingdom ..... 26456/75

[51] Int. Cl.[2] ..... F21V 19/00; F21S 3/12; F21S 13/02

[52] U.S. Cl. ..... 362/382; 248/160; 362/414; 362/457

[58] Field of Search ..... 240/52 R, 81 R, 153; 248/160; 403/56; 63/DIG. 3; 46/25; 362/382, 410, 414, 457

[56] References Cited

U.S. PATENT DOCUMENTS

| | | | |
|---|---|---|---|
| 599,543 | 2/1898 | Whitaker | 248/160 |
| 936,379 | 10/1909 | Stevens | 248/160 |
| 1,279,803 | 9/1918 | Watson | 240/52 R X |

FOREIGN PATENT DOCUMENTS

| | | | |
|---|---|---|---|
| 1,098,836 | 8/1955 | France | 63/DIG. 3 |

*Primary Examiner*—Fred L. Braun
*Attorney, Agent, or Firm*—Holman & Stern

[57] ABSTRACT

A link for use in a flexible support for a light fitting comprises a first section which has a part spherical outer surface and a second section which is connected to the first section and has a part spherical internal surface and a slot opening into said second section. Two similar links can be connected to make part of a flexible support by introducing the first section of a first link into the second section of a second link. The part spherical outer surface of the first section of the first link frictionally engages the part spherical internal surface of the second section of the second link so that the links can be placed in a desired position with respect to one another within limits imposed by the geometry of the slot.

6 Claims, 8 Drawing Figures

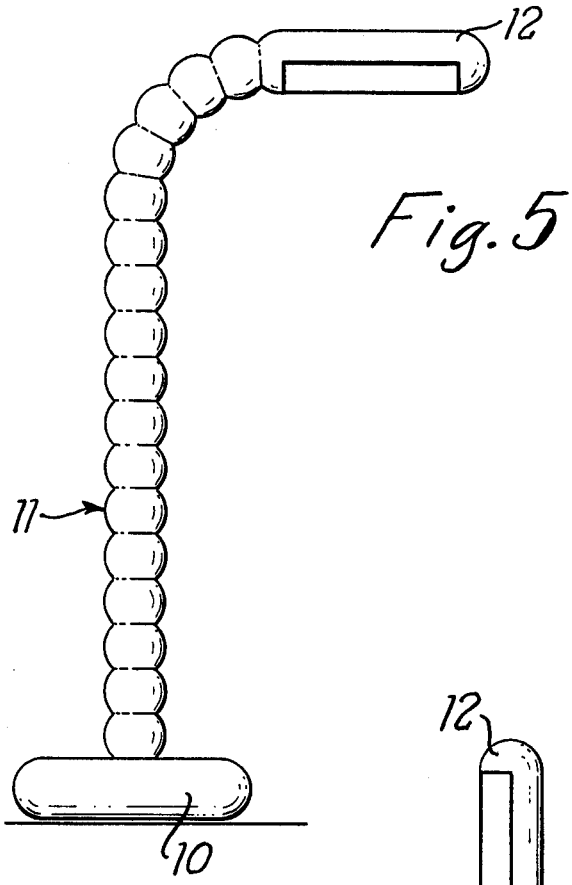
Fig. 5
Fig. 6
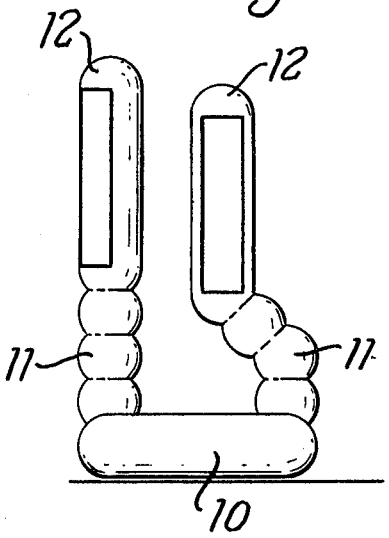

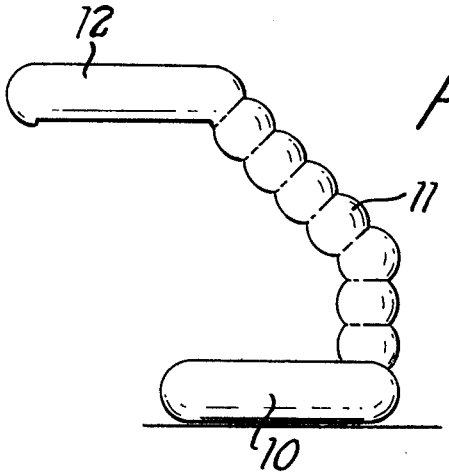
Fig. 7
Fig. 8
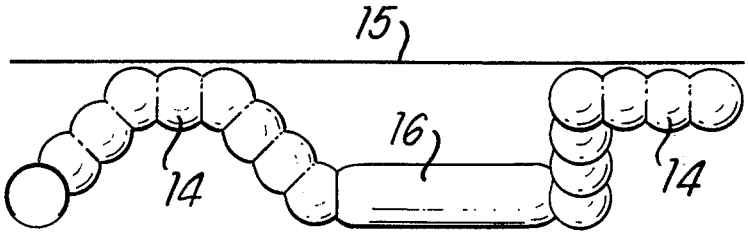

LIGHT FITTINGS

BACKGROUND OF THE INVENTION

This invention relates to flexible supports and, more particularly but not exclusively, is concerned with a link for a flexible support and to light fittings which incorporate such supports.

One known flexible support for light fittings comprises a plurality of alternate cylinders and balls held together by a flexible resilient member passing through the balls and the cylinders.

This support has two main disadvantages. In particular, relative movement between adjacent cylinders is strictly limited and precise control of the position of the light is difficult to achieve.

BRIEF SUMMARY OF THE INVENTION

An object of at least preferred emodiments of the present invention is to provide links which can be joined together to form a flexible support which does not suffer from these disadvantages.

Accordingly, the present invention provides in or for use in a light fitting, a link for a flexible support, which link comprises a first section which has a part sperical outer surface, a second section which is connected to said first section and has a part spherical internal surface, and a slot which opens into said second section, said link being such that the first section of a similar link can be introduced into the second section of said link so that the part spherical outer surface of the first section of said similar link frictionally engages the part spherical internal surface of said second section of said first link and said links can be moved relative to one another within the confines of said slot.

Preferably, the first and second sections intersect to form a waist the external diameter of which is substantially equal to the width of the slot. The ends of the slot may, if desired, be curved and preferably have a radius of curvature which is approximately equal to one half the external diameter of the waist.

Part of the first section remote from the second section is truncated and provided with an aperture. Such an arrangement may permit electric wires to be threaded through a flexible support comprising interconnected links in accordance with the invention and may enable said links to be moved relative to one another by a limited amount without the wire(s) being pinched.

The present invention also embraces flexible supports which comprise links in accordance with the invention and light fittings which incorporate such flexible supports.

BRIEF DESCRIPTION OF THE DRAWING

FIGS. 5, 6, 7 and 8 show four embodiments of light fittings which incorporate flexible supports similar to that shown in FIG. 4.

DETAILED DESCRIPTION OF THE INVENTION

Figure 1:
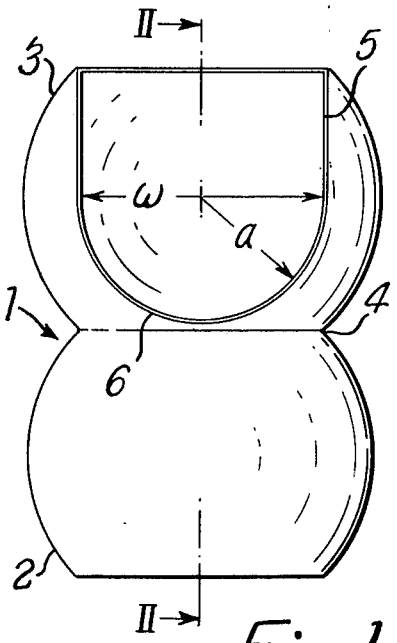
FIG. 1 is a side elevation of a link in accordance with the present invention.
Figure 2:
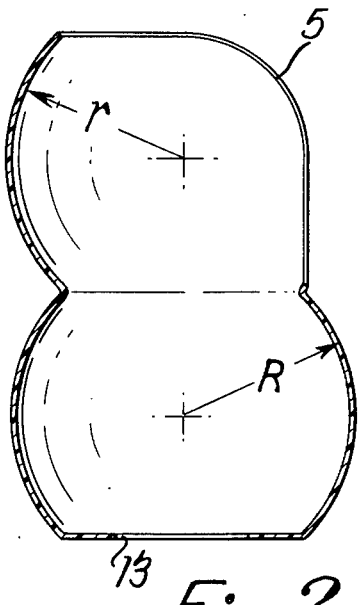
FIG. 2 is a section taken along line II - II of FIG. 1.
Figure 3:
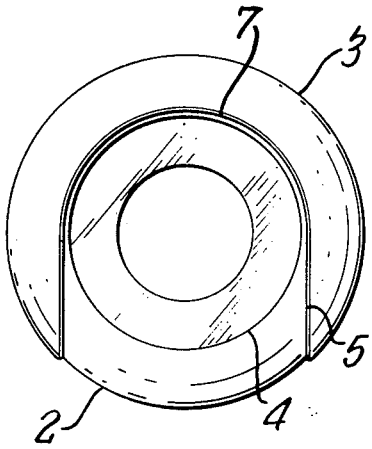
FIG. 3 is a top plan view of the link shown in FIG. 1.

Referring to FIGS. 1 to 3 of the drawings there is shown a link which is generally identified by reference numeral 1. The link 1 is made of resilient plastics material and comprises a first or lower section 2 and a second or upper section 3 which are separated by a waist 4. The outer surface of the lower section 2 is part spherical having a radius of curvature R which is slightly greater than the internal radius *r* (FIG. 2) of the upper section 3. The upper section 3 is provided with a slot 5 which has a width *w* equal to the external diameter of the waist 4. The radius of curvature *a* of each of the ends 6 and 7 of the slot 5 are equal to one another and equal to one half the external diameter of the waist 4. The slot 5 subtends an angle of approximately 180° at the centre of the upper section 3 as viewed in FIG. 2 and this permits one of two interconnected links to be moved through 90° with respect to the other link.

Figure 4:
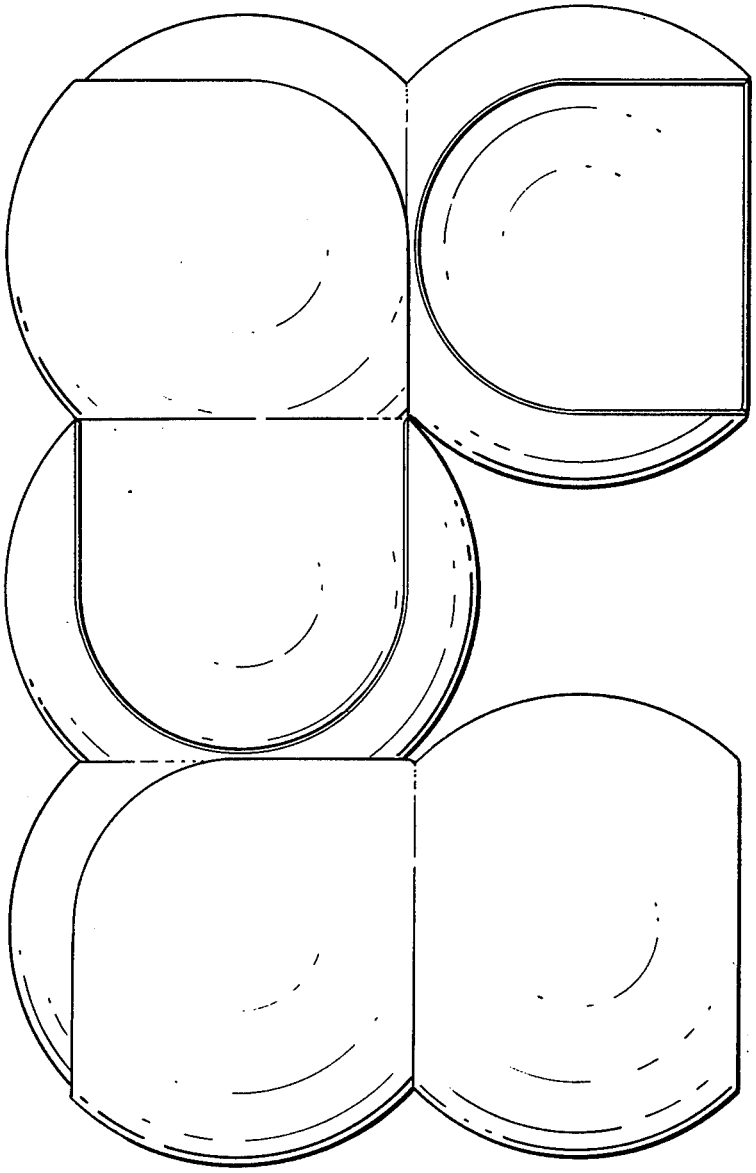
FIG. 4 shows four links similar to the link shown in FIG. 1 combined to make a flexible support.

FIG. 4 shows four links which are similar to the link shown in FIGS. 1 to 3 fitted together to make a flexible support.

Whilst the slot 5 subtends an angle of approximately 180° at the centre of the upper section 3 as viewed in FIG. 2 it should be appreciated that this angle could be increased or decreased with a resulting increae or decrease respectively in the relative possible movement of the links.

By increasing the width *w* of the slot 5 a certain amount of movement transversely of the slot 5 could be provided.

FIGS. 5, 6 and 7 show a lamp standard and two table lamps respectively which each comprise a base 10, flexible support(s) 11, and light holder(s) 12.

In order to conceal electric wires leading to the light holders 12 the lower section of each link may be provided with an aperture. Such an aperture is identified by reference numeral 13 in FIG. 2. It should be noted that the lower part of the lower section 2 is truncated to prevent the electric wires being pinched. However, the lower part could have a spherical surface for other purposes.

FIG. 8 shows a ceiling light. In particular, the flexible supports 14 are secured to ceiling 15 by clips (not shown) and carry electric wires which deliver power to inter alia light holder 15.

Various modifications to the embodiments so far described are envisaged, for example each link could comprise two separate and distinct halves which would be fastened to one another along line II - II of FIG. 1. Such an embodiment would be used where the upper and/or lower sections 2 and 3 were not sufficiently resilient to be interconnected by force. If desired the upper and lower sections 2 and 3 could be separated by, for example a rod.

What is claimed is:

1. In or for use in a flexible support for a light fitting, a link which comprises:

(a) a first section which has a part spherical outer surface; and p1 (b) a second section which is connected to said first section and has a part spherical internal surface, and an elongated slot which opens into said second section communicating with said part spherical internal surface and extends from that portion of said second section remote from said first section to a point on said second section close to said first section;

said link being such that the first section of a similar link can be introduced into the second section of said link so that the part spherical outer surface of the secton of said similar link is commensurate with and frictionally engages the part spherical internal surface of said second section of said link and said links can be moved relative to one another within the confines of said elongated slot.

2. A link according to claim 1, wherein the first and second section intersect to form a waist the external diameter of which is substantially equal to the width of the slot.

3. A link according to claim 2, wherein the ends of the slot are curved and have a radius of curvature which is approximately equal to one half the external diameter of the waist.

4. A link according to claim 1, wherein part of said first section remote from said second section is truncated and provided with an aperture which does not occupy the entire area of the truncated portion which will permit electric wires to be threaded through said link.

5. A plurality of links as claimed in claim 1 when joined together to form a flexible support.

6. A plurality of links as claimed in claim 5 when provided with a light fitting and an electric wire passing through said links internally thereof.

* * * * *